US006796790B2

(12) United States Patent
Venizelos et al.

(10) Patent No.: US 6,796,790 B2
(45) Date of Patent: Sep. 28, 2004

(54) HIGH CAPACITY/LOW $NO_X$ RADIANT WALL BURNER

(75) Inventors: Demetris T. Venizelos, Claremore, OK (US); Wesley Ryan Bussman, Tulsa, OK (US); Ralph Robert Hayes, Collinsville, OK (US); Jesse S. Chambers, Skiatook, OK (US); Roger L. Poe, Beggs, OK (US)

(73) Assignee: John Zink Company LLC, Tulsa, OK (US)

( * ) Notice: Subject to any disclaimer, the term of this patent is extended or adjusted under 35 U.S.C. 154(b) by 94 days.

(21) Appl. No.: 09/949,007

(22) Filed: Sep. 7, 2001

(65) Prior Publication Data

US 2002/0076668 A1 Jun. 20, 2002

Related U.S. Application Data

(63) Continuation-in-part of application No. 09/874,383, filed on Jun. 4, 2001, and a continuation-in-part of application No. 09/803,808, filed on Mar. 12, 2001.

(60) Provisional application No. 60/230,952, filed on Sep. 7, 2000.

(51) Int. Cl.[7] ..... F23C 5/00

(52) U.S. Cl. ..... 431/8; 431/175; 431/284; 431/285

(58) Field of Search ..... 431/348, 278, 431/284, 285, 175, 177, 187, 354, 217, 8, 115, 116; 239/552, 553

(56) References Cited

U.S. PATENT DOCUMENTS 2,671,507 A * 3/1954 Morck ..... 431/348
3,182,712 A * 5/1965 Zink et al. ..... 431/177

(List continued on next page.)

FOREIGN PATENT DOCUMENTS

EP 0 479 414 A1 * 4/1992 ..... F23D/14/02
EP 0 543 478 A 5/1993

(List continued on next page.)

*Primary Examiner*—Josiah Cocks
(74) *Attorney, Agent, or Firm*—James H. Marsh, Jr.; Stinson Morrison Hecker LLP

(57) ABSTRACT

A burner assembly for a radiant burner includes a burner tube structure in the form of an elongated burner conduit having spaced inlet and outlet ends. The conduit is adapted and arranged for directing a fuel lean gaseous mixture comprising a portion of the total fluid fuel to be combusted and oxygen therealong from the inlet end to the outlet end. The assembly also includes a main burner nozzle at the outlet end of the conduit, which nozzle has a central axis, a wall extending around a centrally located chamber therein, and a downstream end spaced from the outlet end of the conduit. The main burner nozzle is arranged and adapted for receiving the mixture from the conduit in the chamber and redirecting the same through a plurality of apertures in the wall and into a combustion zone in a direction transverse to the axis and at a velocity which is greater than the flame speed of the gaseous mixture. The apertures are distributed circumferentially around the wall, whereby the mixture is directed without substantial recirculation and with minimal pressure drop through said apertures and into the combustion zone in the form of a generally round flat pattern which is detached from the nozzle, surrounds the wall and extends outwardly across a radiant surface of a burner tile. The burner also includes an elongated fuel tube extending in a direction generally parallel to the axis, and the fuel tube has a downstream end portion. A secondary fuel nozzle includes a secondary fuel port on the downstream end portion of the fuel tube, which secondary fuel port is located and arranged so as to deliver secondary fuel to a position which is on the opposite side of the fuel pattern from the radiant surface and sufficiently remote from the combustion zone to permit the same to become intermixed with flue gases before entering said combustion zone.

79 Claims, 6 Drawing Sheets

U.S. PATENT DOCUMENTS

| | | | | | |
|---|---|---|---|---|---|
| 4,702,691 | A | * | 10/1987 | Ogden | 431/187 |
| 4,874,310 | A | | 10/1989 | Seemann et al. | |
| 5,154,598 | A | * | 10/1992 | Gooderham et al. | 431/188 |
| 5,180,302 | A | * | 1/1993 | Schwartz et al. | 431/348 |
| 5,271,729 | A | * | 12/1993 | Gensler et al. | 431/175 |
| 5,709,541 | A | * | 1/1998 | Gensler et al. | 431/10 |

FOREIGN PATENT DOCUMENTS

| | | | | | |
|---|---|---|---|---|---|
| EP | 0 588 191 | A2 | * | 9/1993 | F23D/14/12 |
| EP | 0 592 081 | A | | 4/1994 | |
| EP | 0 751343 | A | | 1/1997 | |
| EP | 0 787947 | A | | 8/1997 | |
| EP | 0 787 947 | A2 | * | 8/1997 | F23D/14/04 |

* cited by examiner

HIGH CAPACITY/LOW $NO_X$ RADIANT WALL BURNER

CROSS REFERENCES TO RELATED APPLICATIONS

Priority is claimed in the present application pursuant to 35 U.S.C. § 119(e) from provisional application Ser. No. 60/230,952, filed Sep. 7, 2000, the entirety of the disclosure of which is hereby specifically incorporated herein by this specific reference thereto. In addition, the present application is a continuation-in-part of co-pending application Ser. No. 09/874,383, filed Jun. 4, 2001 and priority is claimed therefrom pursuant to 35 U.S.C. § 120. Furthermore, the present application is a continuation-in-part of co-pending application Ser. No. 09/803,808, filed Mar. 12, 2001 and priority is claimed therefrom pursuant to 35 U.S.C. § 120. The entireties of the disclosures of said applications Ser. No. 09/874,383 and Ser. No. 09/803,808 are also hereby specifically incorporated herein by this specific reference thereto.

BACKGROUND OF THE INVENTION

1. Field of the Invention

The present invention relates to the field of industrial burners and in particular to radiant wall burners which operate to heat the surrounding portions of a wall of a furnace or the like, which often consist of a burner tile, and these heated surrounding portions then distribute heat by radiation in the furnace. Even more particularly, the invention relates to methodology and apparatus whereby the efficiency and capacity and $NO_x$ reduction capabilities of radiant burners is enhanced.

2. The State of the Prior Art

Reduction and/or abatement of $NO_x$ in radiant burners has always been a desirable aim. Moreover, it has always been a desirable aim in the industry to increase the heat production of known burners which use a primary premix produced by inducing a flow of air with fluid fuel but previous burners have not been capable of producing fuel-air premixes containing less than about 80% of the total fuel. Such premixes combust at high temperatures resulting in excessive production of $NO_x$ and other contaminants. Moreover, the amount of secondary fuel available for other purposes such as carrying flue gas into the flame has been extremely limited because the primary fuel-air premix includes the bulk of the fuel needed for combustion. Accordingly the industry has needed means for improving the efficiency of burners for radiant burner applications such that the primary pre-mix is leaner in fuel whereby a large mass of air is available during the initial combustion to reduce the combustion temperature and a large amount of secondary fuel is available for circulating in the furnace space away from the flame so as to premix with a large amount of flue gas to further reduce combustion temperatures. The industry has also needed radiant burners with greater heat production capacities.

SUMMARY OF THE INVENTION

The present invention alleviates the problems discussed above and enhances radiant burner installations by providing a high capacity, low $NO_x$ radiant wall burner assembly wherein the primary fuel-air premix has a much higher air content and a correspondingly much lower fuel content than previously thought possible by those skilled in the art. The burner of the invention is also capable of generating greater amounts of heat than previously known burners. In accordance with the concepts and principles of the invention, a high capacity radiant burner is provided which includes a burner tube structure comprising an elongated burner conduit having spaced inlet and outlet ends. The conduit is adapted and arranged for directing a fuel lean gaseous mixture comprising a portion of the total fluid fuel to be combusted and oxygen therealong from the inlet end to the outlet end. A main burner nozzle is provided at the outlet end of the conduit, and such burner nozzle has a central axis, a wall extending around a centrally located chamber therein, and a downstream end spaced from the outlet end of the conduit. The main burner nozzle is arranged and adapted for receiving the fuel lean fuel-air mixture from the conduit in the chamber and redirecting the same without substantial recirculation and with minimal pressure drop through a plurality of apertures in the wall and into a combustion zone in a direction transverse to the axis and at a velocity which is greater than the flame speed of the gaseous mixture. The apertures are distributed around the wall, whereby the fuel-air mixture directed into the combustion zone through the apertures is generally in the form of a round flat pattern which is detached from the nozzle, surrounds the wall and extends outwardly across a radiant surface of a burner tile. Ideally, the fuel lean gaseous mixture includes all of the oxygen needed for combusting the total fuel delivered to the furnace.

The burner of the invention also includes an elongated fuel tube that extends in a direction generally parallel to the axis of the nozzle. The fuel tube has a downstream end portion and a secondary fuel nozzle including at least one secondary fuel port is positioned on the downstream end portion of the fuel tube. Each secondary fuel port is located and arranged so as to deliver secondary fuel to a location in the furnace which is on the opposite side of the round flat pattern from the radiant surface and is sufficiently remote from the combustion zone to permit the same to become intermixed with flue gases before entering the combustion zone.

In accordance with the invention, the elongated fuel tube may be located externally of the main fuel nozzle and each secondary fuel port may be located and arranged so as to deliver secondary fuel at a velocity and in a direction such that at least a portion of the secondary fuel pierces the pattern to reach the proper location described above. Alternatively, the elongated fuel tube may extend through the main fuel nozzle and protrude through the downstream end thereof to deliver the secondary fuel directly to the location which is on the opposite side of the fuel-air pattern from the radiant surface.

Preferably, the burner tube structure may comprise a venturi tube which uses a flow of the gaseous fuel to induce a flow of air, whereby to create the fuel lean fuel-air mixture. Ideally, the mixture may comprise a mixture of a gaseous fuel and air.

In another form of the invention, the burner tube structure may comprise a plurality of venturi tubes arranged for parallel flow, each of the venturis being adapted and arranged to use a flow of the gaseous fuel to induce a flow of air, whereby to generate the mixture as an ultra fuel lean mixture of fuel and air.

In a more specific sense, the high capacity, low $NO_x$ radiant wall burner according to the invention may include an elongated nozzle arrangement adapted for installation in a central passageway of a refractory burner tile inserted in a wall of a furnace adjacent a combustion zone. The tile may preferably have a radiant surface surrounding the passageway and located adjacent the combustion zone. The nozzle arrangement may include an elongated burner tube including an elongated downstream portion configured to extend through the passageway and an elongated upstream portion, such portions may have respective centrally disposed, longitudinally extending axes. The nozzle arrangement may also include a fuel-air mixture supply system providing a source of a fuel lean combustible fuel-air mixture for introduction into the burner tube, an upstream end of the upstream portion of the burner tube being connected in fluid communication with the fuel supply system for receiving the fuel lean combustible fuel-air mixture, the burner tube providing a conduit for flow of the fuel lean combustible fuel-air mixture therealong from the upstream end to a downstream end of the downstream portion of the burner tube.

The nozzle arrangement of the invention may further include a main nozzle positioned at the downstream end of the downstream portion of the burner tube adjacent the radiant surface, the main nozzle having an internal chamber that is in fluid communication with the downstream end of the downstream portion of the burner tube for receiving the fuel lean combustible fuel-air mixture flowing along the tube. The main nozzle is arranged and configured to redirect the fuel-air mixture in the chamber and cause it to flow without substantial recirculation in a direction radially outwardly relative to the axis of the downstream portion of the burner tube, into the combustion zone, and generally across the radiant surface. The main nozzle has a wall extending around the chamber and a series of radially extending openings in the wall. The openings are arranged and configured to dispense the combustible fuel-air mixture in a radial direction at an initial velocity which exceeds the flame speed of the mixture and in a circular pattern which essentially surrounds the nozzle in a radial direction, whereby a detached round flame is created when the mixture is combusting. Finally, the burner arrangement may desirably include a secondary fuel nozzle system including an elongated fuel tube extending longitudinally of the downstream portion of the burner tube and having at least one fuel gas port disposed and arranged to direct a flow of secondary fuel to a location in the furnace on an opposite side of the combustion zone from the radiant surface. The secondary fuel constitutes a substantial portion of the total fuel provided to the combustion zone by the fuel-air mixture supply system and the secondary fuel nozzle system.

In accordance with a highly preferred form of the invention, the fuel-air supply system of the burner may comprise an ejector including a fuel inlet connectable to a source of pressurized fluid fuel, a fluid fuel spud connected in fluid communication with the inlet and positioned for ejecting fluid fuel through a space in fluid communication with a source of air, and a generally bell-shaped fitting mounted at the upstream end of the upstream portion of the burner tube. The bell-shaped fitting has a mouth positioned for receiving the ejected fluid fuel and air carried along with it and directing the same into the upstream end of the burner tube.

In one form of the invention, the axes of the portions of the burner tube may be superimposed whereby the burner tube is essentially straight. Thus, the main nozzle, the burner tube and the ejector are in essential alignment along the superimposed axes. In an alternative form of the invention, the axis of the upstream portion may be disposed at an angle relative to the axis of the downstream portion, whereby the main nozzle and the downstream portion of the burner tube are disposed in essential alignment along the axis of the downstream portion, and the ejector and the upstream portion of the burner tube are disposed in essential alignment along the axis of the upstream portion.

In one form of the invention, the elongated fuel tube may be located outside the main nozzle. Preferably, in this form of the invention, the secondary fuel nozzle system may include a plurality of elongated fuel tubes located outside the main nozzle. Desirably, the ports of the secondary fuel tubes are each configured and positioned to cause at least a portion of the secondary fuel to pierce the fuel-air mixture pattern and reach the desired location in the furnace without combusting.

In another form of the invention, the main nozzle may includes an end cap having a hole in it, and wherein the fuel tube extends through the chamber and a downstream portion thereof protrudes through the hole. A port in the downstream portion of the fuel tube is positioned adjacent the desired location in the furnace. Desirably, a plurality of ports may be provided in the downstream portion of the fuel tube and the location in the furnace may surround the downstream portion of the fuel tube.

In accordance with the concepts and principles of the invention, the radiant surface may be either essentially flat or cup-shaped. Desirably, the end cap may be convex relative to the chamber.

In another form of the invention, where the secondary fuel nozzle extends through the main nozzle and an eductor is used to premix the primary fuel-air mixture, the secondary fuel system may desirably be arranged to bypass the eductor. This may be done as discussed above by arranging the axes of the upstream and downstream portions of the burner tube at an angle. Alternatively, the secondary fuel system may include a segment of tubing which extends laterally through a wall of the downstream portion of the burner tube, such segment being connected in fluid communication with an upstream end of the fuel tube.

In a highly preferred form of the invention, the openings in the nozzle wall may desirably comprise elongated slots which extend in a direction that is essentially parallel to the axis of the downstream portion of the burner tube. Preferably, the wall of the nozzle may comprise a series of circumferentially spaced bars presenting the slots therebetween, the bars having rounded surfaces adjacent the chamber to inhibit the formation of recirculation zones in the chamber. Ideally, the burner may include an internal baffle having a generally bell-shaped downstream portion located in the chamber. The bell-shaped portion may have an outer, circumferentially extending edge disposed adjacent the wall. Additionally, the slots may have an upstream end and a downstream end, and the outer edge of the bell-shaped portion may be located closer to the upstream end of the slot than to the downstream end of the slot. Ideally, the outer edge of the bell-shaped portion may be located approximately one-fourth of the distance from the upstream end of the slot to the downstream end of the slot. Furthermore, the slots may desirably have upstream end surfaces that slope in a direction of fluid flow to inhibit the formation of recirculation zones in the chamber.

In a preferred form of the invention, the fuel-air mixture supply system and the secondary fuel system may be arranged such that the amount of the secondary fuel constitutes more than about 20%, desirably at least about 30% and ideally at least about 50 to 60% of the total fuel provided to the combustion zone. In a further preferred form of the invention, the relationship between the velocity that the primary fuel-air mixture leaves the slots and the flame speed of the mixture is such that the upstream extremity of the detached flame is positioned between about 1 inch and 3 inches from the nozzle to make sure that the radiant tile is heated evenly.

In accordance with another preferred aspect of the invention, when the axes of the upstream and downstream portions of the burner tube are disposed at an angle, the burner tube may desirably include a curved portion which interconnects the downstream and upstream portions thereof, and the secondary fuel system may include a segment of tubing which extends through a wall of the curved portion of the burner tube. This segment of tubing is connected in fluid communication with an upstream end of the fuel tube. Ideally, the arrangement is such that the segment of tubing and the fuel tube extend essentially along the axis of the downstream portion of the burner tube and the eductor is offset at an angle. With this arrangement, the eductor for the primary fuel-air mixture is bypassed by the secondary fuel system, and the overall longitudinal dimensions of the burner are reduced.

The invention further provides a method for operating a high capacity, low $NO_x$ radiant wall burner. The method comprises (1) delivering a flow of a fuel lean combustible mixture comprising a portion of the total fuel to be combusted and air in a radial direction from an elongated nozzle having a central axis to a combustion zone surrounding the nozzle in the form of a round flat pattern which surrounds the wall and at a composition where the flame speed of the mixture is lower than the velocity of the mixture as the latter exits the nozzle, the combustion zone being adjacent a radiant face of a burner tile; (2) igniting the mixture to create a round flat detached flame which surrounds the nozzle in a radial direction and is located adjacent the radiant face; and (3) providing a supply of secondary fuel at a location on the opposite side of the flame from the radiant face and spaced far enough away from the flame so that the secondary fuel becomes intermixed with flue gas before it enters the flame.

More specifically, the method may desirably comprise (1) providing a fuel lean combustible fuel-air mixture; (2) causing the fuel-air mixture to flow outwardly from a main nozzle, into the combustion zone and generally across the radiant surface in a circular pattern which essentially surrounds the main nozzle in a radial direction; (3) causing the fuel-air mixture to flow outwardly from the main nozzle at an initial velocity which exceeds the flame speed of the mixture, whereby a detached round flame is created when the mixture is combusting; and (4) providing a secondary fuel at a location in the furnace on an opposite side of the zone from the radiant surface, the secondary fuel constituting a substantial portion of the total fuel provided to the combustion zone by the fuel-air mixture supply system and the secondary fuel nozzle system.

In accordance with the invention, the secondary fuel desirably constitutes more than about 20%, preferably constitutes at least about 30% and ideally constitutes at least about 50 to 60% of the total fuel provided to the combustion zone.

In one form of the invention, the secondary fuel is provided at the location on the opposite side of the primary fuel-air pattern using a secondary fuel nozzle which extends through the main nozzle. Alternatively, the secondary fuel is provided at the location using a secondary fuel nozzle which emits a jet of fuel that pierces the pattern without combusting.

DETAILED DESCRIPTION OF PREFERRED EMBODIMENTS OF THE INVENTION

The invention provides a high capacity, low $NO_x$ radiant wall burner. In one important aspect, the invention focuses on the provision of a high capacity, low $NO_x$ radiant wall burner which employs a fuel-lean fuel-air mixture to fuel the primary flame. Fuel lean primary fuel-air mixtures assist in improving turn down ratios, at least in part because fuel lean fuel-air mixtures are slow burning and have a reduced combustion velocity. Fuel lean primary fuel-air mixtures also operate to reduce, and perhaps eliminate completely the need for secondary air, which often increases the production of NOx. Leaner fuel-air combustion mixtures, however, tend to reduce the overall capacity of the main burner and it has previously been thought that the highest capacity possible for such burners having an outside nozzle diameter of about 5.5 inches is no more than about 1.2 MMBtu/hr. In accordance with the invention, however, capacities above about 2.0 MMBtu/hr have become routine without adversely affecting $NO_x$ output. In fact, when the burners of the invention are used to achieve high outputs, $NO_x$ levels have often been improved. The burners of the invention, due to the increased capacity and reduced flame speed, also provide uniform heating of the radiant tiles and a reduced tendency for flashback, even when the fuel is predominantly hydrogen. In this latter regard, the type of fuel used by the burner is not intended to be a critical limitation, and in accordance with the concepts and principles of the invention, the burner of the invention may be used with any sort of available combustible fluid fuel or fuel mixture, including, but not limited to, natural gas, hydrogen, mixtures of natural gas and hydrogen, etc.

Figure 1:
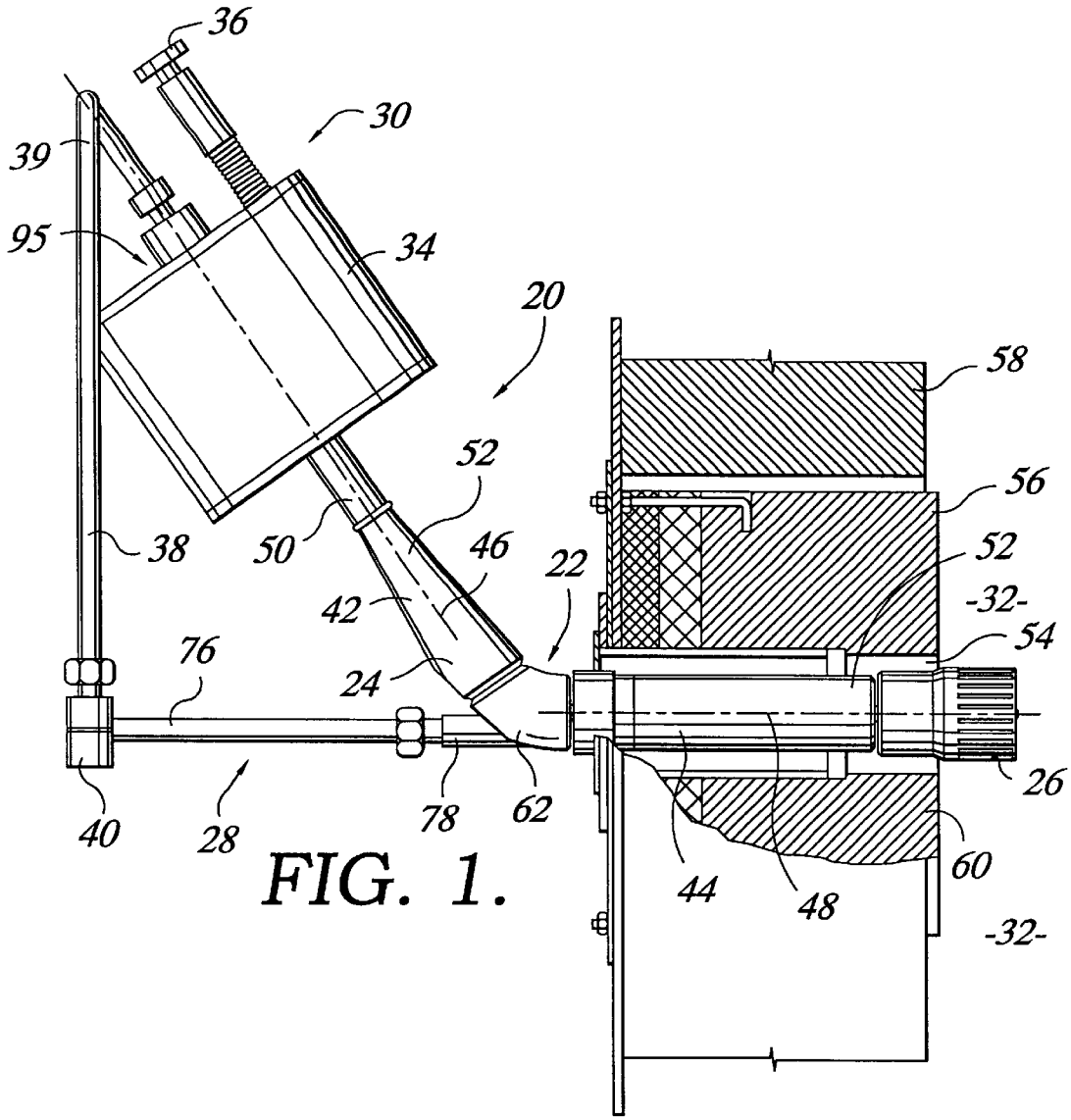
FIG. 1 is a side elevational view, partly in cross-section, illustrating a high capacity, low $NO_x$ radiant wall burner which embodies the concepts and principles of the invention and associated accessories.

One embodiment of a burner which is based on the concepts and principles of the invention is illustrated in FIG. 1, where it is identified by the reference numeral 20. The burner 20 desirably consists generally of an elongated nozzle arrangement 22 which includes an elongated burner tube 24, a main burner nozzle 26, a secondary fuel system 28, and a fuel-air mixture supply system 30 which desirably provides a fuel lean primary combustible fuel-air mixture to the burner tube 24 for delivery to the nozzle 26 for ultimate distribution to a combustion zone 32 that generally surrounds nozzle 26 in a radial direction. As shown at least partly in FIG. 1, the burner 20 includes all of the conventional components which are usually associated with industrial burners, including a muffler 34, an air control 36 and a fuel gas manifold arrangement 38, including an inlet 40, for receiving and delivering a fluid, preferably gaseous fuel to the burner 20 from a supply source (not shown in the drawings) and a primary fuel supply line 39. For convenience, the secondary system 28 may also be connected to inlet 40 as shown. The gaseous fuel may desirably be natural gas or a mixture of natural gas and hydrogen.

The burner tube 24, which provides a conduit for conducting a flow of a fuel lean mixture of fuel and air from the supply system 30 to the nozzle 26, includes, as shown on FIG. 1, an elongated upstream portion 42 and an elongated downstream portion 44. The portions 42, 44 have respective, centrally disposed axes 46,48 which extend longitudinally therealong. The downstream portion 44 is configured to extend through a central passageway 54 provided in a refractory burner tile 56 arranged in the wall 58 of a furnace or the like.

Tile 56 has a radiant surface 60 which surrounds passageway 54 and is adjacent combustion zone 32 so as to be heated by combustion occurring in zone 32 during operation. As shown in FIG. 1, the surface 60 may be essentially flat; however, other shapes are well known to those skilled in the art. Thus, as can be seen from FIG. 1, main nozzle 26 is positioned at the downstream end 52 of downstream portion 44 of the burner tube 24 adjacent radiant surface 60.

With further reference to FIG. 1, it can be seen that the burner tube 24 may preferably include a curved portion (or elbow) 62 interconnecting portions 42 and 44. Accordingly, the axes 46, 48 are disposed at an angle, with the nozzle 26 and the downstream portion 44 aligned along axis 48, and with the upstream portion 42 and the supply system 30 aligned along axis 46.

Figure 2:
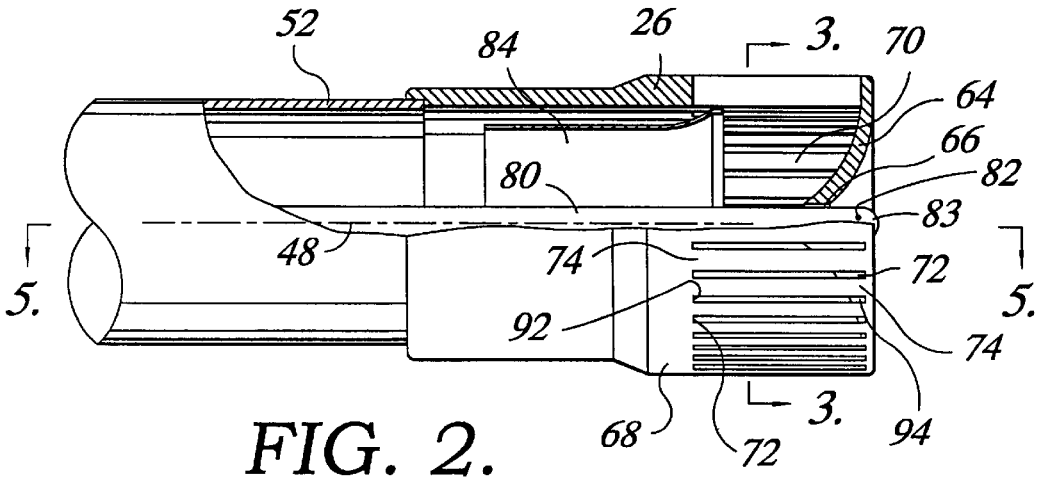
FIG. 2 is an enlarged view, partly in cross-section, of certain major components of the burner of FIG. 1.
Figure 3:
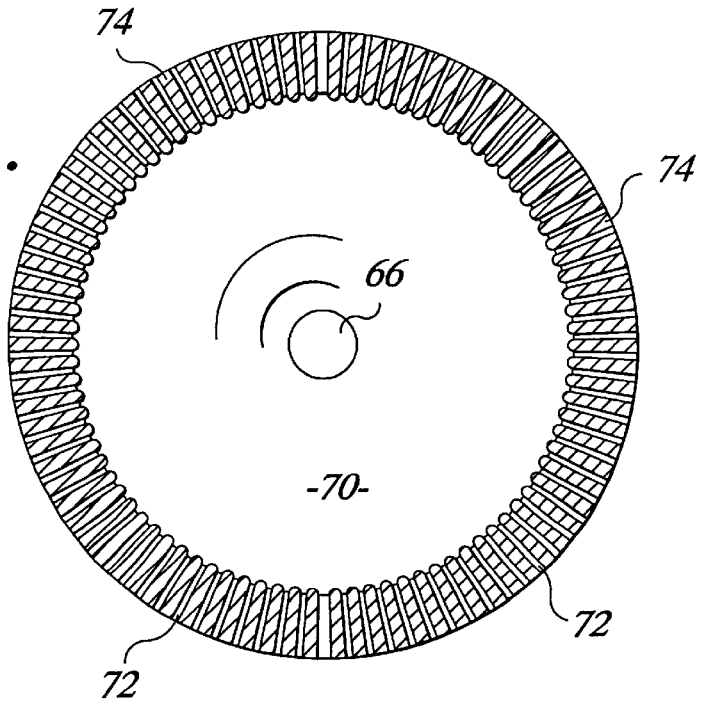
FIG. 3 is a cross-sectional view taken long the line 3—3 of FIG. 2.

As can be seen viewing FIG. 2, nozzle 26 is provided with an inwardly curved, generally trumpet-shaped end cap 64 having a centrally located hole 66 therein. Nozzle 26 also includes a wall 68 which extends completely therearound. Thus, the end cap 64 and the wall 68 define a chamber 70 inside nozzle 26 which is in fluid communication with the downstream end 52 of downstream portion 44 of burner tube 24 so as to receive the fuel lean fuel-air mixture from the burner tube 24. As can be seen viewing FIG. 2, the end cap 64 is convex relative to chamber 70. Thus, the nozzle 26 is configured and arranged to redirect the fuel lean primary fuel-air mixture without substantial recirculation and cause it to flow outwardly away from nozzle 26 in a direction radially outward relative to axis 48. Thus, the primary mixture flows into combustion zone 32 and across the radiant surface 60. To this end, the nozzle 26 is provided with a circumferentially extending series of radially extending openings 72, which preferably are in the form of elongated, axially extending slots. These elongated slots 72, which extend in a direction that is essentially parallel to the axis 48, are preferably defined by a series of circumferentially spaced bars 74 as can be seen viewing FIG. 3. Desirably, in one very important application of the invention, the nozzle 26 may be cylindrical and approximately 5.5 inches in outer diameter. The bars 74 may be approximately one-half inch wide in a radial direction so that the inside diameter of chamber 70 is approximately 4.5 inches. The nozzle 26 may have approximately 90 slots, each of which is about 2 inches long and about 0.055 inches wide. With regard to the foregoing, while these dimensions, etc. are preferred for an existing application, it is to be understood that the dimensions of the nozzle and the slots are not critical features of the invention. For example, in retrofit applications, the diameter of the nozzle may generally be limited by the size of an existing nozzle passageway and the size and shape of the slots may be limited by furnace capacity and fuel characteristics and parameters. In new furnace construction there is more freedom and there is no particular limitation on nozzle diameter. Regarding slot size and shape, suffice it to say that sufficient area must be provided to handle the volumetric flow rate of the fuel-air mixture and provide an escape velocity which exceeds the flame speed of the mixture and positions the detached upstream end of the flame such that the radiant surface is heated evenly. As will be appreciated by those skilled in the art, the optimum dimensions may depend upon such variables as the characteristics and parameters of the available fuel, the heating capacity of the furnace and the total volume of the primary fuel-air mixture, and as a result, slot dimensions for any given application may often need to be determined empirically so as to minimize pressure drop and the presence of recirculation zones within the nozzle.

The secondary fuel system 28 may include a length of tubing 76 which is connected through a fitting 78 permitting tubing 76 to enter tube 24 through elbow 62. Inside tube 24, tubing 76 is connected in fluid communication with the upstream end of an elongated secondary fuel tube 80 that extends longitudinally of downstream portion 44 of tube 24 along axis 48. As can be seen in FIG. 2, fuel tube 80 extends through chamber 70 and has a downstream end 82 which protrudes through hole 66 in end cap 64. With reference to FIG. 1, it can be seen that the end 82 is provided with one or more ports 83 to direct the flow of secondary fuel outwardly into the furnace space. Tube 80 may also be provided with an internal orifice 85 to control the flow of the secondary fuel which desirably constitutes a substantial portion of the total fuel supplied to the combustion zone.

Figure 5:
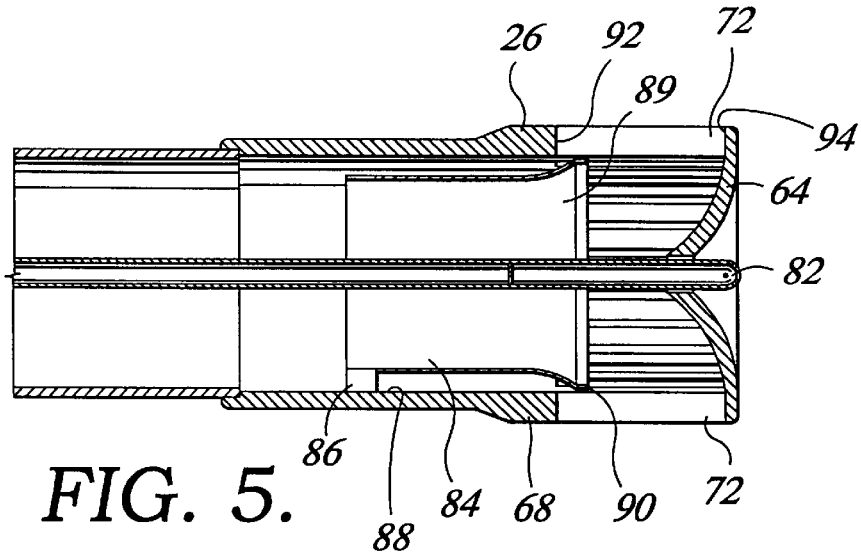
FIG. 5 is a cross-sectional view taken long the line 5—5 of FIG. 2.

With reference now to FIG. 5, it can be seen that the burner assembly 22 may desirably include a baffle 84 that is mounted within chamber 70 of nozzle 26. Baffle 84 may be provided with a series of tabs 86 (only one is shown) which may be attached to the inner surface 88 of wall 68 by welding or the like to properly center and position baffle 84. Baffle 84 may preferably have a bell shaped downstream portion 89 having an outer circumferentially extending edge 90 that is positioned adjacent the inner surface 88 of wall 68. Slots 72 desirably each have an upstream end 92 and a downstream end 94, and it is preferred that the axial position of baffle 84 is such that edge 90 is closer to the upstream ends 92 than to the downstream ends 94. Ideally, the edge 90 may be positioned approximately one-fourth of the distance from the upstream ends 92 to the downstream ends 94. That is to say, when the slots 72 are 2 inches long, the edge 90 may desirably be positioned one-half inch in an axial direction from the ends 92 of the slots 72. With regard to the axial position of edge 90, it is to be appreciated by those skilled in the art that this also is not a critical limitation on the scope of the invention. Suffice it to say in this regard that the optimal axial position of the edge 90 is simply that position where both pressure drop and the development of recirculation zones are minimized.

Figure 13:
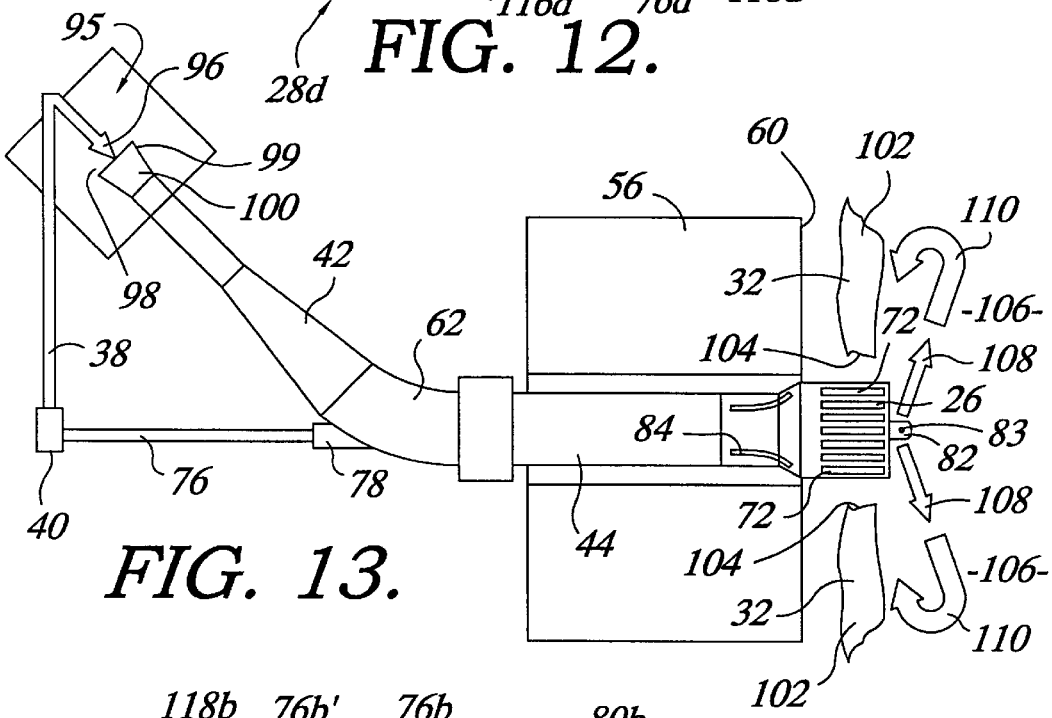
FIG. 13 is a schematic, elevational view of illustrating the operational principles of the burner of FIG. 1.
Figure 17:
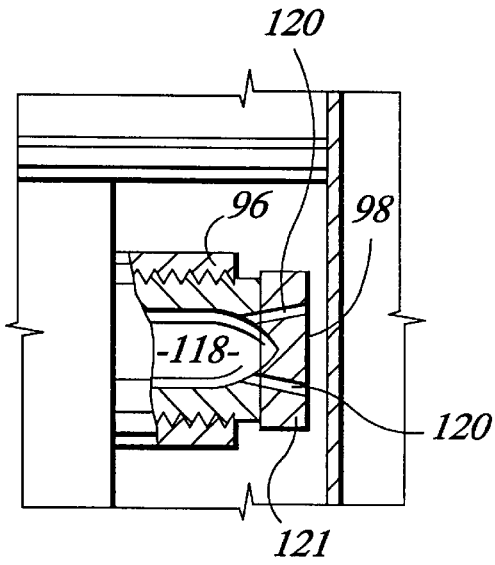
FIG. 17 is an enlarged detail view of the circled portion of FIG. 10.

The fuel-air mixture supply system 30 may be in the form of a conventional ejector or venturi 95 which includes a primary nozzle or spud 96 for ejecting gas jets through a space 98 that is in communication with a source of air and a venturi inlet bell 100. These components are mounted inside muffler 34 in FIG. 1 and cannot be seen. However, the spud 96, the space 98 and the inlet bell 100 are shown schematically in FIG. 13 which also illustrates the operation of the burner 20. The details of an appropriate spud 96 are also illustrated in FIG. 17 where it can be seen that the spud 96 may desirably include an internal fuel chamber 118 which is connected to fuel supply line 39 (See FIG. 1) and a plurality of, preferably three, jet orifices 120. The orifices 120, which may be drilled in an end plate 121 of spud 96, are sized to provide an appropriate flow rate to the nozzle 26. The spud is connected to a supply of pressurized gas which gas is ejected through jet orifices 120 and through space 98 where air is entrained therein. The fuel gas and the entrained air are injected in a generally parallel direction relative to axis 46. The motive energy from the fuel gas provides the energy used to aspirate the surrounding combustion air into the inlet bell 100 and through the venturi section of the burner. The mixture of fuel and entrained air, which desirably is a fuel lean mixture, then flows into and is received by the open end or mouth 99 of the inlet bell 100.

The upstream portion 42 of the burner tube 24 may include a venturi throat portion 50 and a diffuser portion 51. The inlet bell 100 is designed to provide a smooth, uniform flow path for the combustion air from space 98 into the venturi throat 50. The venturi throat 50, which is located just downstream of the inlet bell 100, consists essentially of a straight tube. The design parameters of the tube, and particularly its length and diameter, are important because they play a critical role in the aspiration performance of the combustion air. The downstream end of the venturi throat is attached to the diffuser 52. The diffuser 52 may preferably be in the form of an elongated conical section that provides a gradual transition from the throat 50 to the long radius elbow 62. The long radius elbow 62 provides two functions. First, it allows the venturi to be offset so as to conveniently position the secondary fuel system 28 to bypass the venturi throat section 50. This design configuration provides a substantial improvement in air aspiration performance as compared to designs where the secondary fuel riser is located along the centerline of the throat. This design increases the aspiration performance of the combustion air that results in a lower flame temperature providing a substantial reduction of $NO_x$ emissions. Secondly, the elbow 62 provides a method for reducing the overall length of the burner. In many applications the overall length of the burner is limited to furnace space constraints. Using elbows with different angles allow designs to meet specific customer needs. The downstream portion 44, which may be in the form of a tube with a specific length, is attached to the downstream end of the elbow. When the air-fuel mixture exits the long radius elbow the flow patterns of the air-fuel mixture are highly skewed. The downstream portion 44 allows the gas flow profile to become evenly distributed before the same enters the burner nozzle 26. An even flow distribution through the burner nozzle is important for good flame quality.

In operation, the slots 72, in association with the baffle 84, dispense the fuel lean primary fuel-air mixture without substantial recirculation and with minimal pressure drop in a radial direction at an initial velocity that exceeds the flame speed of the mixture. This desirable flame speed condition may be determined empirically depending upon the total flow area provided by the slots, the total flow volume of the fuel-air mixture, and the pressure of the latter. The slots 72 are also arranged so as to direct the primary fuel-air mixture radially outward from the nozzle 26 so as to form therefrom, in zone 32, a circular pattern 102 which surrounds nozzle 26 in a radial direction. Preferably, the fuel lean primary fuel-air mixture dispensed via slots 72 contains less than 80% of the total fuel to be combusted in the combustion zone 32. Even more desirably, the fuel lean primary fuel-air mixture contains less than about 70% of the total fuel to be combusted in the combustion zone 32. And ideally, the fuel lean primary fuel-air mixture may contain less than about 50% of the total fuel to be combusted in the combustion zone 32. As a result of the initial velocity of the mixture, the circular pattern 102 desirably provides a flame, when combustion occurs, that is detached from the nozzle 26 and has an upstream extremity 104 that is located approximately between 1 and 3 inches from the nozzle 26.

At the same time that the primary fuel-air mixture is directed radially from nozzle 26, secondary fuel traversing the downstream end 82 of tube 80, which protrudes axially from end cap 64 of nozzle 26, is directed by ports 83 to an adjacent location 106 which surrounds downstream end 82 of fuel tube 80 within the furnace but is downstream from pattern 102 and on the opposite side thereof from radiant surface 60. This flow is illustrated by the arrows 108 in FIG. 13. As the fuel circulates through the furnace space away from the combustion zone 32, it entrains flue gases and eventually returns to the primary combustion zone 32 where it enters into the combustion reaction. This entrainment is illustrated by the arrows 110. The presence of the entrained flue gases operates to reduce flame temperature and therefore $NO_x$ production. In accordance with the invention, the secondary fuel may preferably be more than about 20%, desirably at least about 30% and ideally 50 to 60% or more of the total fuel supplied to the combustion zone.

Figure 6:
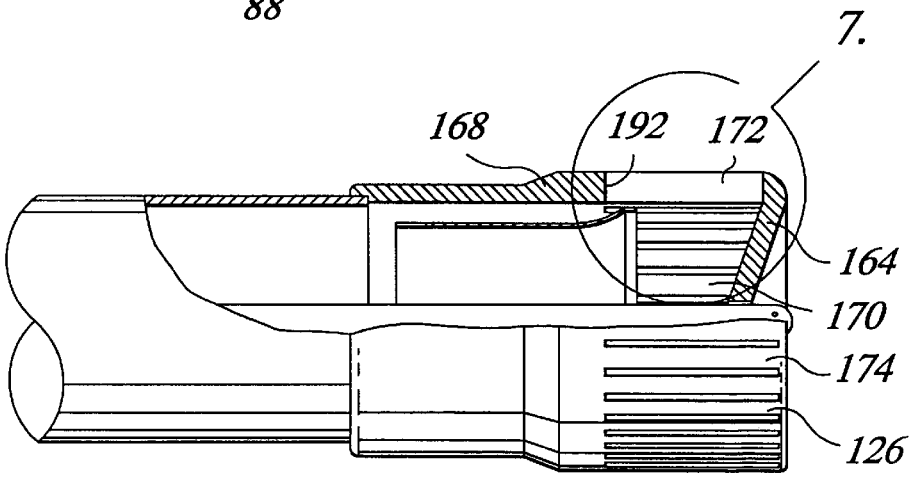
FIG. 6 is a view that is similar to FIG. 5 except the end cap for the main nozzle has a slightly different shape.
Figure 7:
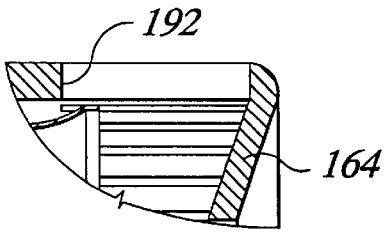
FIG. 7 is an enlarged detail view of the circled portion of FIG. 6.

An end cap having an alternative shape is identified by the reference numeral 164 in FIG. 6. In this case, the end cap 164 is generally conical in shape. Other than the shape of the end cap 164 and the dimensions thereof, the nozzle 126 of FIG. 6 is essentially the same as the nozzle 26 of FIG. 5. Desirably, in another very important application of the invention, the nozzle 126 may be cylindrical and approximately 3.375 inches in outer diameter. The bars 174 may be approximately one-fourth inch wide in a radial direction so that the inside diameter of chamber 170 is approximately 2.875 inches. The nozzle 126 may have approximately 60 slots 172, each of which is about 2 inches long and about 0.058 inches wide.

Figure 8:
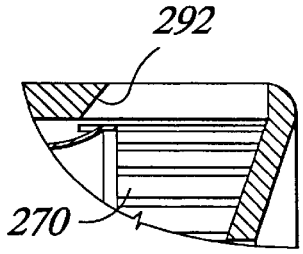
FIG. 8 is a detail view similar to FIG. 7, except for the configuration of the entrance portion of the slots.

In both FIGS. 5 and 6, the upstream end surfaces 92, 192 of the slots 72, 172 are shown as being flat and disposed in a plane which is essentially perpendicular to walls 68, 168. Alternatively, these end surfaces may be sloped in the direction of fluid flow as illustrated in FIG. 8, where the sloped end surfaces are identified by the reference numeral 292. The sloped surfaces 292 may assist in inhibiting the formation of recirculation zones in chamber 270. In this same vein, and with reference to FIG. 3, the internal edges 112 of bars 74 may desirably be rounded, again to assist in the inhibition of recirculation zones in chamber 70.

The main burner nozzle 26 thus includes a series of slots that allow the combustible air-fuel mixture to exit the burner nozzle 26 in a radial direction, generally parallel to the furnace wall and across the radiant surface 60 without substantial recirculation and with minimal pressure drop in the nozzle 26. The width, depth, and length of these slots may be optimized by those skilled in the art so as to provide an appropriate exit area needed for the required burner firing capacity and to ensure that the burner operates without flashback. The internal baffle 84 located inside the burner nozzle 26 is used to help redirect the air-fuel mixture in such a manner as to prevent recirculation zones in the region of the burner nozzle 26. The prevention of recirculation zones near the burner nozzle 26 is important because it helps reduce $NO_x$ emissions by assisting in the detachment of the primary flame from the burner nozzle 26. Detaching the primary flame from the main burner nozzle 26 allows more furnace gases to be entrained into the flame. This results in a reduction in the flame temperture that lowers $NO_x$ emissions. Internal baffles similar to the baffle 84 are illustrated in U.S. Pat. No. 4,702,691. However, the internal baffle 84 is used in a different manner in accordance with the principles and concepts of the present invention. Thus, the baffle 84 is used to reduce the amount of energy required to aspirate the air-fuel mixture through the burner nozzle 26 by minimizing the pressure drop and presence of recirculation zones in the nozzle 26. The overall design thus provides a burner nozzle and eductor system which is able to aspirate more combustion air resulting in a leaner primary air-fuel mixture. Such a leaner air-fuel mixture results in a reduction of flame temperature resulting in lower $NO_x$ emissions.

$NO_x$ emissions may be reduced even further using the staged fuel concept described above. The staged fuel is delivered to a location in the furnace on the opposite side of the combustion zone from the radiant tile. The fuel may be staged using a riser that is inserted through the venturi elbow section and through the center of the burner downstream section and nozzle. A staged fuel nozzle protrudes through the center of the end plate of the burner nozzle. The ports of the staged fuel riser are preferably designed so that the staged fuel is injected at a location spaced from the furnace wall and primary flame. The staged fuel mixes with furnace gases before being entrained into the primary flame. The mixing of the staged fuel with the furnace flue gases, prior to combustion, reduces the flame temperature resulting in a reduction in $NO_x$ emissions. The exact angle of injection is not critical, so long as the secondary fuel remains away from the main combustion zone for a sufficient length of time to entrain a substantial $NO_x$ reducing amount of furnace gases. In actual practice, the secondary fuel may leave the riser therefor at an angle which is outward, inward or parallel to the furnace wall.

Figure 4:
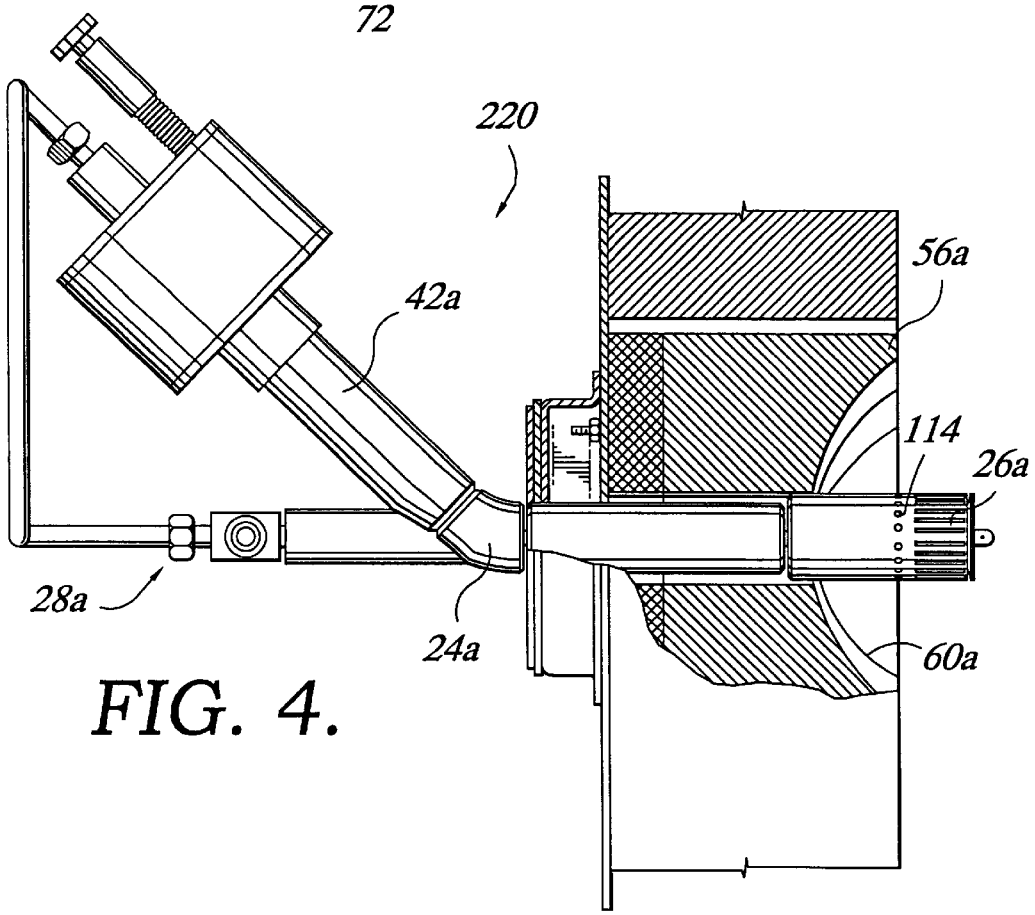
FIG. 4 is a side elevational view, partly in cross-section, illustrating another embodiment of a high capacity, low $NO_x$ radiant wall burner which embodies the concepts and principles of the invention and associated accessories.

An alternative embodiment of a high capacity, low $NO_x$ radiant wall burner which embodies the concepts and principles of the invention is illustrated in FIG. 4, where it is identified by the reference numeral 220. The only essential difference between the burner 220 and the burner 20 is that the upstream portion 42*a* of the burner tube 24*a* is cylindrical rather than conical. In addition, the nozzle 26*a* is provided with a series of holes 114 to increase the flow area for the radially directed primary fuel lean fuel-air mixture. FIG. 4 also illustrates the use of the burner of the invention in conjunction with a tile 56*a* having a concave or cup-shaped radiant surface 60*a*.

Figure 9:
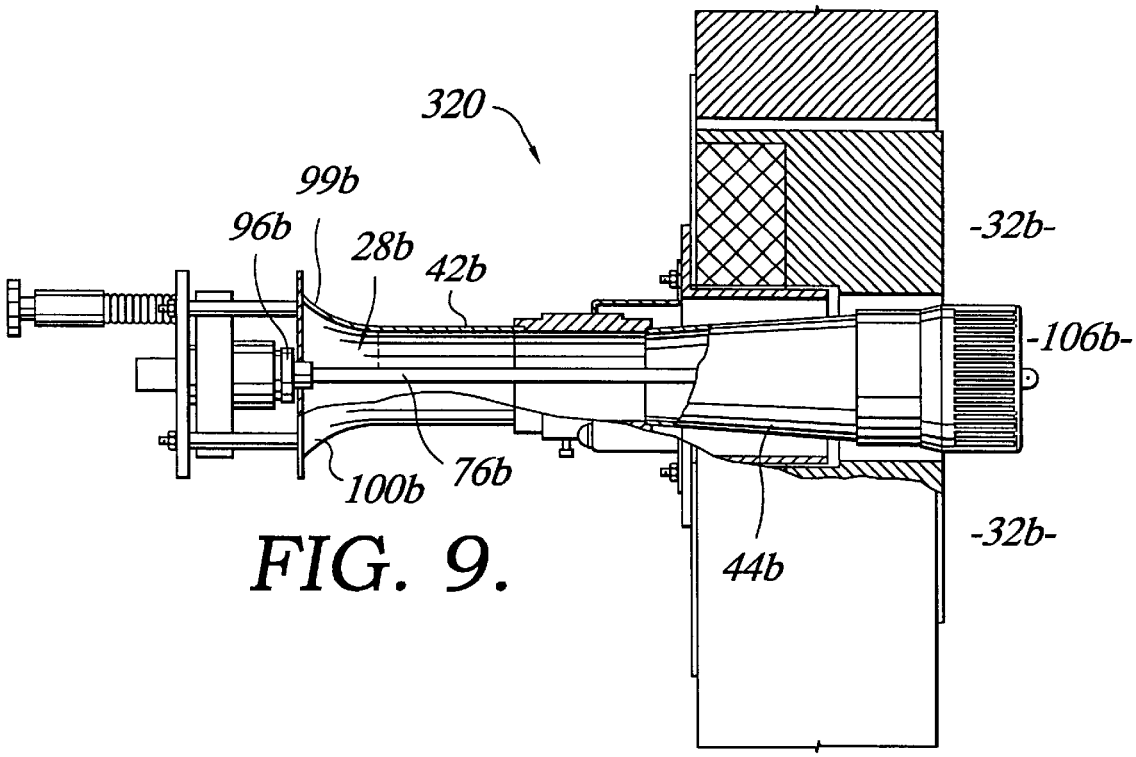
FIG. 9 is a side elevational view, partly in cross-section, illustrating yet another embodiment of a high capacity, low $NO_x$ radiant wall burner which embodies the concepts and principles of the invention and associated accessories.
Figure 16:
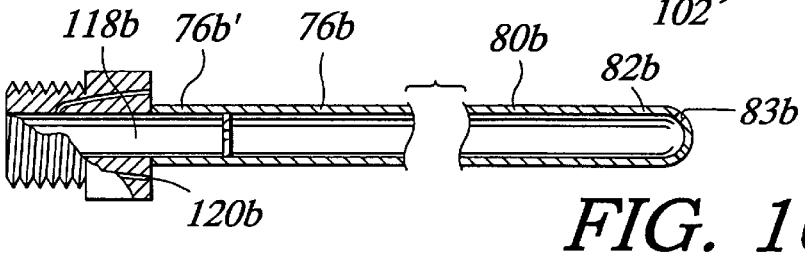
FIG. 16 is an enlarged cross-sectional view illustrating the details of the primary fuel delivery spud and the secondary fuel delivery system of the burner of FIG. 9.

Another alternative embodiment of a high capacity, low $NO_x$ radiant wall burner which embodies the concepts and principles of the invention is illustrated in FIG. 9, where it is identified by the reference numeral 320. In the burner 320, the upstream portion 42*b* of the burner tube 24*b* is aligned axially with the downstream portion 44*b*. Thus, the burner tube 24*b* is straight. In this case, the secondary fuel system 28*b* includes a tubing segment 76*b* which extends from spud 96*b* through the bell shaped fitting 100*b*. The details of the arrangement of the spud 96*b* and the tubing segment 76*b* are illustrated in FIG. 16 where it can be seen that the chamber 118*b* is in direct communication with the upstream end 76*b*' of the tubing segment 76*b*. The spud 96*b* is provided with a plurality of primary fuel ejecting ports 120*b* which are arranged around upstream end 76*b*' of the tubing segment 76*b* in a location for inducing the flow of air into the upstream end 99*b* of bell-shaped fitting 100*b*. Tubing segment 76*b* is connected to secondary fuel tube 80*b* having a downstream portion 82*b* provided with ports 83*b*. These ports 83*b* operate to deliver secondary fuel to the location 106*b* on the opposite side of the combustion zone 32*b* from the radiant surface 60*b*. A shortcoming of this embodiment, although it is fully operable in a functional sense, is that the tubing segment 76*b* extends through the throat of the ejector and diminishes the flow area thereof. Accordingly, as explained above, the capacity of the ejector to induce the flow of air is reduced and it is therefore more difficult to produce an ultra fuel lean premix using this embodiment.

Figure 10:
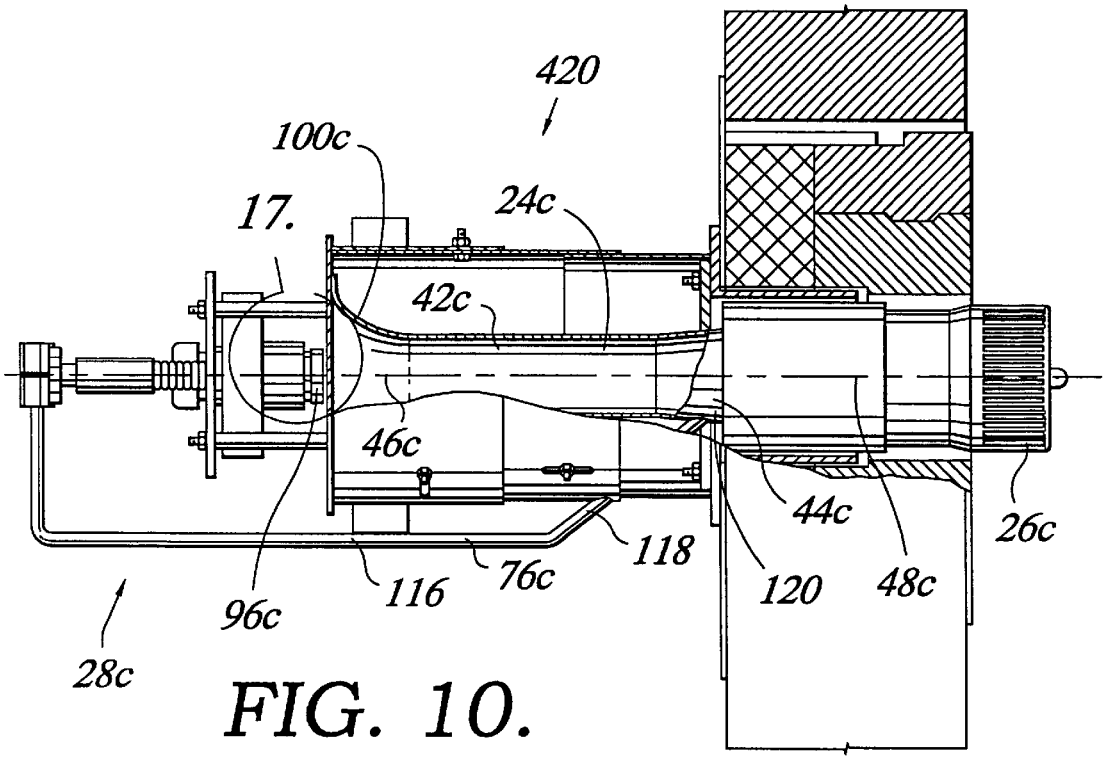
FIG. 10 is a side elevational view, partly in cross-section, illustrating a further embodiment of a high capacity, low $NO_x$ radiant wall burner which embodies the concepts and principles of the invention and associated accessories.
Figure 11:
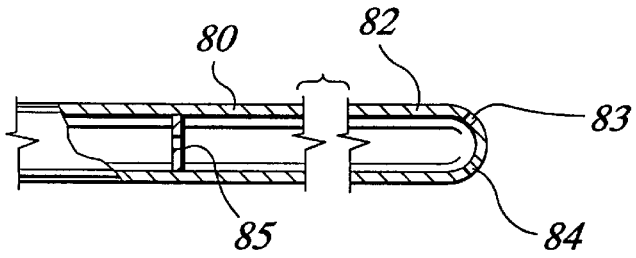
FIG. 11 is an enlarged cross-sectional view illustrating the downstream portions of a secondary fuel nozzle which is useful in connection with the various embodiments of the invention.

Yet another alternative embodiment of a high capacity, low $NO_x$ radiant wall burner which embodies the concepts and principles of the invention is illustrated in FIG. 10, where it is identified by the reference numeral 420. In the burner 420, just like in the burner 320 of FIG. 9, the upstream portion 42*c* of the burner tube 24*c* is aligned axially with the downstream portion 44*c*. That is, the axes 46*c* and 48*c* are superimposed, the burner tube 24*c* is straight, and the main nozzle 26*c*, the burner tube 24*c*, the bell shaped fitting 100*c* and the ejector spud 96*c* are in essential alignment along the superimposed axes 46*c*, 48*c*. Spud 96*c* of FIG. 10 is identified by the reference numeral 96 in FIG. 11. In burner 420, however, the problems of burner 320 are avoided in that the secondary fuel system 28*c* is designed to bypass the ejector system provided by the spud 96*c* and bell shaped fitting 100*c*. To this end, the system 28*c* includes a secondary fuel tubing segment 76*c* disposed outside the upstream portion 42*c* of the burner tube 24*c*. As shown in FIG. 10, tubing segment 76*c* may include a straight length 116 and an angled length 118. Length 118 is disposed at an angle relative to length 116 and extends through wall 120 of downstream portion 44*c*. The downstream end of length 118 (not shown in FIG. 10), is connected in fluid communication with the upstream end of secondary fuel tube 80*c*. The tube 80*c* may be the same as the tube 80 depicted in FIG. 11. It is to be noted in connection with the foregoing that the secondary fuel systems 28 and 28*a* of burners 20 of FIG. 1 and 220 of FIG. 4 respectively, also totally bypass the ejector system to avoid the shortcomings of the burner 320 of FIG. 9.

Figure 12:
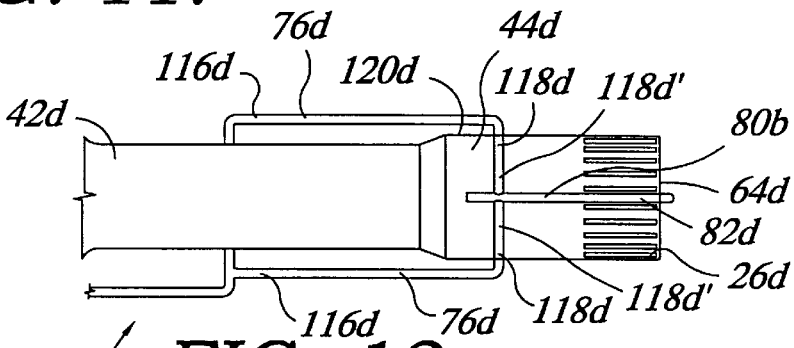
FIG. 12 is a schematic, elevational view of a further embodiment of a burner which embodies the concepts and principles of the invention.

An arrangement which is similar to the arrangement of burner 420 of FIG. 10 is illustrated schematically in FIG. 12. In the burner arrangement of FIG. 12, the secondary fuel system 28*d* includes a plurality of segments 76*d* which bypass the upstream portion 42*d*. Each of these segments 76*d* include straight lengths 116*d* and angled lengths 118*d*. As can be seen in FIG. 12, lengths 118*d* extend through the wall 120*d* of downstream portion 44*d*, and the downstream ends 118*d*' of lengths 118*d* are connected in fluid communication with an upstream end of tube 80*d*, the downstream end 82*d* of which extends through nozzle 26*d* and end cap 64*d*.

Figure 14:
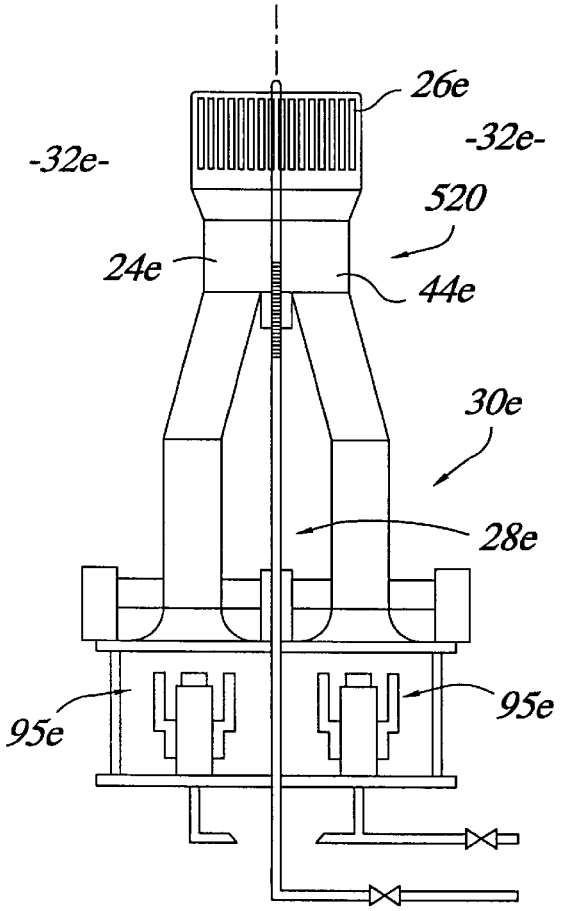
FIG. 14 is a schematic, side elevational view illustrating a yet another high capacity, low $NO_x$ radiant wall burner which embodies the concepts and principles of the invention and associated accessories.

Yet another alternative embodiment of a high capacity, low $NO_x$ radiant wall burner which embodies the concepts and principles of the invention is illustrated schematically in FIG. 14, where it is identified by the reference numeral 520. The burner 520 may be essentially the same as the burner 20 of FIG. 1 in all functional respects, except that in this case the fuel-air mixture supply system 30*e* which provides a fuel lean primary combustible fuel-air mixture to the burner tube 24*e* for delivery to the nozzle 26*e* for ultimate distribution to a combustion zone 32*e*, may include more than one upstream ejector or venturi 95*e*. The multiple venturi system useful in connection with the burner 520 is fully described and illustrated in said co-pending application Ser. No. 09/874,383 and may include a multiplicity of venturis. That is to say, the number of venturis which may be combined to deliver a primary fuel-air mixture to the downstream portion 44*e*, which may be in the form of a collector, may number 2 or 3 or 4 or even 8 or more, and the exact number is limited only by the physical dimensions of the space where the burner is to be used. Suffice it to say that the use of multiple venturis may enable shortening of the length of the overall system and the production of ultra lean primary fuel-air mixtures. It is also to be noted that in the burner 520, the centrally located secondary fuel system 28*e* fully bypasses the venturis 95*e*.

Figure 15:
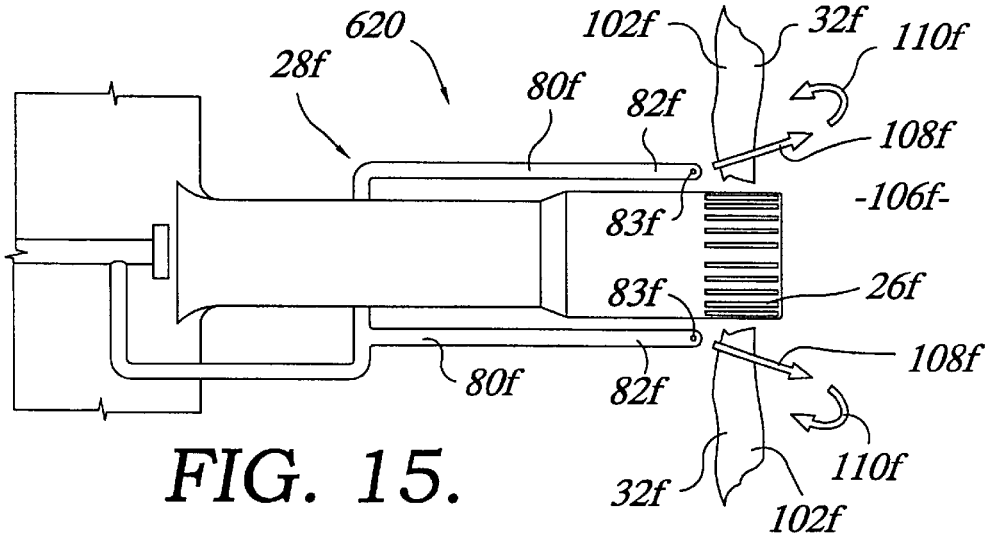
FIG. 15 is a schematic, elevational view illustrating the operational principles of another burner which embodies the concepts and principles of the invention.

A further alternative embodiment of a high capacity, low $NO_x$ radiant wall burner which embodies the concepts and principles of the invention is illustrated schematically in FIG. 15, where it is identified by the reference numeral 620. In this case, the elongated fuel tubes 80*f* of the secondary fuel system 28*f* are disposed outside the nozzle 26*f*. Each tube 80*f* has a downstream end portion 82*f* which is similar to the end portion 82 illustrated in FIG. 11. That is to say, each portion 82*f* may be provided with one or more ports 83*f* configured and positioned so that at least a portion of the secondary fuel is delivered to the location 106*f* which is within the furnace but is downstream from pattern 102*f* created by nozzle 26*f* in the manner described above in connection with the burner 20 of FIG. 1 and which is on the opposite side of pattern 102*f* from the radiant surface (not shown in FIG. 15). The secondary fuel is delivered by ports 83*f* to location 106*f* by causing the same to be delivered in an appropriate direction and at a sufficient velocity to pierce through the pattern 102*f* without combusting so as to reach location 106*f* in an uncombusted condition. This piercing flow is illustrated by the arrows 108*f* in FIG. 15. As the fuel circulates through the furnace space adjacent location 106*f* away from the combustion zone 32*f*, it entrains flue gases and eventually returns to the primary combustion zone 32*f* where it enters into the combustion reaction. This entrainment is illustrated by the arrows 110*f*. The staged fuel risers are preferably designed so that the staged fuel is injected into the furnace at a pressure ranging from 2 to 15 psig, and at an angle from the horizontal. Part of the injected fuel mixes with the primary flame, but a substantial portion thereof penetrates through the primary flame envelope and into the furnace downstream from the primary flame where it mixes with furnace gases before being re-entrained into the primary flame. Previously, as illustrated in U.S. Pat. No. 5,180,302, similar external secondary fuel nozzles were open ended tubes, and the secondary fuel gas simply mixed with the primary flame. In the present case, however, the secondary gas is carefully metered by the ports 83*f* and accelerated by the pressure of the fuel such that piercing of the primary flame occurs.

In summation, the invention thus provides a high capacity, low $NO_x$ partially premixed, staged fuel burner. Preferably, the burner includes a venturi section that is optimized sufficiently to deliver a fuel lean premixed mixture of fuel and air to the main nozzle of the burner. The main burner nozzle, which is located at the exit end of the venturi section, has radially directed exit slots which allow the combustible mixture to exit the main nozzle in a radial direction and generally parallel to the furnace wall. In accordance with the concepts and principles of the invention, the width, depth, and length of these slots are optimized to provide the appropriate total exit area necessary for the high burner firing capacity, and to ensure that the burner operates without flashback problems using fuel mixtures that may often contain high levels of hydrogen. The flame established by the main burner nozzle is called the primary flame. The design of the exit slots of the main burner nozzle, and the use of at least one internal baffle to aid in turning the premixed fuel air flow without recirculation zones being formed, result in a flame that is normally sustained at a certain distance away from the burner. This "detachment" of the primary flame results in larger amounts of furnace flue gases being entrained into the primary flame, thus reducing the $NO_x$ emissions. The use of a fuel lean fuel-air mixture for the primary flame is an important parameter in "detaching" the flame from the main burner. The fuel lean primary gas mixture preferably falls in a range of flammability conditions that make it difficult for the flame to become attached on the burner tip. Supplementation of the primary flame envelope with staged fuel provides the additional fuel needed to make the combustible mixtures fall in the appropriate range for stable combustion.

In addition, the $NO_x$ emissions are further reduced with the injection of staged fuel. The fuel can be staged using side mounted risers equipped with staged-fuel tips. The fuel can also be staged using a center riser that is inserted through the venturi-burner tip assembly and protrudes through the end plate of the burner tip. Preferably, however, the fuel is staged using a secondary fuel tube which bypasses the venturi portion of the burner but still passes through the main nozzle and protrudes through the nozzle end plate.

The staged fuel may desirably be injected into the furnace at a location on the opposite side of the primary combustion zone from the radiant tile and at a pressure ranging from 2 to 15 psig. In addition, the secondary fuel is injected into the furnace at an angle from the and away from the primary flame. The staged fuel mixes with furnace gases before being entrained into the primary flame. Because of the way the staged fuel is injected and the pressure used in the process, the "secondary", or rather, the staged flames established are short (especially with heavier hydrocarbon fuels), well defined, and away from the furnace tile, resulting in uniform heating of the furnace tile and wall. The center riser results in lower noise emissions, because of the use of multiple ports to deliver primary fuel main burner tip. The use of multiple fuel ports causes a shift in the jet generated noise to higher frequencies.

Typical premixed burners do not utilize successfully so many technologies and basic theories at once to achieve high firing capacities, extremely low $NO_x$ emissions, and high stability over a wide range of operating capacities and fuels, as the new design described by this disclosure does. The new design displays the following performance characteristics:

1. High firing capacity without increasing burner diameter;
2. Very low $NO_x$;
3. Short flame profiles;
4. Detached primary flame;
5. Extremely uniform tile and furnace wall heating;
6. High turndown ratios due to leaner primary fuel-air mixtures;
7. High stability at all operating conditions;
8. Operation using fuel mixtures containing high levels of hydrogen;
9. Low noise generation;
10. Effective and efficient operation in most commercially available tiles;
11. Utilization of staged fuel for lower $NO_x$ emissions;
12. Secondary fuel induced flue gas recirculation for lower $NO_x$ emissions;
13. Simplicity.

We claim:

1. A high capacity, low $NO_x$ radiant wall burner including an elongated nozzle arrangement adapted for installation in a passageway in a wall of a furnace adjacent a combustion zone, said furnace wall providing a radiant surface surrounding said passageway and located adjacent said zone, said nozzle arrangement comprising:

an elongated burner tube including an elongated downstream portion configured to extend through said passageway and an elongated upstream portion, said portions having respective centrally disposed, longitudinally extending axes;

a fuel-air mixture supply system providing a source of a fuel lean combustible fuel-air mixture for introduction into said burner tube, an upstream end of the upstream portion of the burner tube being connected in fluid communication with the fuel supply system for receiving the fuel lean combustible fuel-air mixture therefrom, said tube providing a conduit for flow of said fuel lean combustible fuel-air mixture therealong from said upstream end to a downstream end of the downstream end of the downstream portion of the burner tube;

a main nozzle positioned at the downstream end of said downstream portion of the burner tube adjacent said radiant surface, said main nozzle having an internal cavity that is in fluid communication with the downstream end of the downstream portion of the burner tube for receiving the fuel lean combustible fuel-air mixture flowing along the tube, said main nozzle being arranged and configured to redirect the fuel-air mixture in the cavity and cause it to flow in a direction radially outwardly relative to said axis of the downstream portion of the burner tube, into said zone, and generally across said radiant surface, said main nozzle including a wall extending around the cavity and a series of radially extending opening in the wall of the main nozzle, said openings being arranged and configured to dispense said combustible fuel-air mixture in said radial direction at an initial velocity which exceeds the flame speed of the mixture and in a circular pattern which essentially surrounds said nozzle in a radial direction, whereby a detached round flame is created when the mixture is combusting; and a secondary fuel nozzle system including an elongated secondary fuel tube longitudinally of said downstream portion of the burner and having at least one fuel gas port that is configured, positioned and arranged to discharge a flow of secondary fuel and cause the same to travel in a direction outwardly away from said radiant surface to a location that is axially spaced from and out of contact with said zone, whereby the secondary fuel will have an opportunity become mixed with flue gases before undergoing combustion with excess air in the combustion zone, said secondary fuel constituting a substantial portion of the total fuel provided to said combustion zone by said fuel-air mixture supply system and said secondary fuel nozzle system.

2. A high capacity, low $NO_x$ radiant wall burner as set forth in claim 1, wherein said fuel-air supply system comprises an ejector including a fuel inlet connectable to a source of pressurized fluid fuel, a fluid fuel spud connected in fluid communication with said inlet and positioned for ejecting fluid fuel through a space in fluid communication with a source of air, and a fitting mounted at said upstream end of the upstream portion of the burner tube, said fitting having a mouth positioned for receiving a premix comprising the ejected fluid fuel and air carried along with it and directing the same into the upstream end of the burner tube.

3. A high capacity, low $NO_x$ radiant wall burner as set forth in claim 2, wherein said axes are superimposed whereby said burner tube is essentially straight and said main nozzle, said burner tube and said ejector are in essential alignment along said axes.

4. A high capacity, low $NO_x$ radiant wall burner as set forth in claim 2, wherein the axis of the upstream portion is disposed at an angle relative to the axis of the downstream portion thereof, whereby said main nozzle and said downstream portion of the burner tube are disposed in essential alignment along the axis of said downstream portion, and said ejector and said upstream portion of the burner tube are disposed in essential alignment along the axis of said upstream portion.

5. A high capacity, low $NO_x$ radiant wall burner as set forth in claim 1, wherein said elongated secondary fuel tube is located outside said main nozzle.

6. A high capacity, low $NO_x$ radiant wall burner as set forth in claim 1, wherein said secondary fuel nozzle system includes a plurality of said secondary elongated fuel tubes, said fuel tubes all being located outside said main nozzle.

7. A high capacity, low $NO_x$ radiant wall burner as set forth in claim 5, wherein said port is configured, positioned and arranged to cause at least a portion of the secondary fuel to pierce the fuel-air mixture pattern and reach said location in the furnace without combusting.

8. A high capacity, low $NO_x$ radiant wall burner as set forth in claim 1, wherein said main nozzle includes an end cap having a hole in it, and wherein said secondary fuel tube extends through said cavity and a downstream portion thereof protrudes through said hole, said port being in said downstream portion of the fuel tube and positioned adjacent said location in the furnace.

9. A high capacity, low $NO_x$ radiant wall burner as set forth in claim 8, wherein a plurality of said ports are provided in said downstream portion of the fuel tube and said location in the furnace surrounds said downstream portion of the secondary fuel tube.

10. A high capacity, low $NO_x$ radiant wall burner as set forth in claim 1, wherein said radiant surface is essentially flat.

11. A high capacity, low $NO_x$ radiant wall burner as set forth in claim 1, wherein said radiant surface is concave.

12. A high capacity, low $NO_x$ radiant wall burner as set forth in claim 11, wherein said radiant surface is cup-shaped.

13. A high capacity, low $NO_x$ radiant wall burner as set forth in claim 8, wherein said secondary fuel system includes a segment of tubing which extends through a wall of said downstream portion of the burner tube, said segment being connected in fluid communication with an upstream end of the secondary fuel tube.

14. A high capacity, low $NO_x$ radiant wall burner as set forth in claim 8, wherein said end cap is convex relative to said cavity.

15. A high capacity, low $NO_x$ radiant wall burner as set forth in claim 1, wherein said openings comprise elongated slots which extend in a direction which is essentially parallel to the axis of the downstream portion of the burner tube.

16. A high capacity, low $NO_x$ radiant wall burner as set forth in claim 15, wherein said wall of the main nozzle comprises a series of circumferentially spaced bars presenting said slots therebetween, said bars having rounded surfaces adjacent said cavity to inhibit the formation of recirculation zones in the cavity.

17. A high capacity, low $NO_x$ radiant wall burner as set forth in claim 1, wherein said burner includes at least one baffle having a generally bell-shaped downstream portion located in said cavity, said bell-shaped portion having an outer, circumferentially extending edge disposed adjacent said wall of the main nozzle.

18. A high capacity, low $NO_x$ radiant wall burner as set forth in claim 15, wherein said burner includes at least one baffle having a generally bell-shaped downstream portion located in said cavity, said bell-shaped portion having an outer, circumferentially extending edge disposed adjacent said wall of the main nozzle.

19. A high capacity, low $NO_x$ radiant wall burner as set forth in claim 18, wherein said slots have an upstream end and a downstream end and said outer edge of the bell-shaped portion is located closer to the upstream end of the slot than to the downstream end of the slot.

20. A high capacity, low $NO_x$ radiant wall burner as set forth in claim 19, wherein said outer edge of the bell-shaped portion is located approximately one-fourth of the distance from the upstream end of the slot to the downstream end of the slot.

21. A high capacity, low $NO_x$ radiant wall burner as set forth in claim 18, wherein said slots have upstream end surfaces that slope in a direction of fluid flow to inhibit the formation of recirculation zones in the cavity.

22. A high capacity, low $NO_x$ radiant wall burner as set forth in claim 1, wherein said fuel-air mixture supply system and secondary fuel system are configured and arranged such that the amount of said secondary fuel constitutes more than about 20% of the total fuel provided to the combustion zone.

23. A high capacity, low $NO_x$ radiant wall burner as set forth in claim 22, wherein said fuel-air mixture supply system and said secondary fuel system are arranged such that the amount of said secondary fuel constitutes at least about 30% of the total fuel provided to the combustion zone.

24. A high capacity, low $NO_x$ radiant wall burner as set forth in claim 23, wherein said fuel-air mixture supply system and said secondary fuel system are arranged such that the amount of said secondary fuel constitutes at least about 50% of the total fuel provided to the combustion zone.

25. A high capacity, low $NO_x$ radiant wall burner as set forth in claim 22, wherein said secondary fuel nozzle system is arranged for connection of the elongated fuel tube to a source of fuel gas at a pressure of at least about 2 psig.

26. A high capacity, low $NO_x$ radiant wall burner as set forth in claim 25, wherein said secondary fuel nozzle system is arranged for connection of the elongated fuel tube to a source of fuel gas at a pressure of at least about 3 psig.

27. A high capacity, low $NO_x$ radiant wall burner as set forth in claim 26, wherein said secondary fuel nozzle system is arranged for connection of the elongated fuel tube to a source of fuel gas at a pressure of at least about 5 psig.

28. A high capacity, low $NO_x$ radiant wall burner as set forth in claim 27, wherein said secondary fuel nozzle system is arranged for connection of the elongated fuel tube to a source of fuel gas at a pressure of at least about 10 psig.

29. A high capacity, low $NO_x$ radiant wall burner as set forth in claim 28, wherein said secondary fuel nozzle system is arranged for connection of the elongated fuel tube to a source of fuel gas at a pressure of at least about 15 psig.

30. A high capacity, low $NO_x$ radiant wall burner as set forth in claim 1, wherein an upstream extremity of said flame is positioned at least about 1 inch from said nozzle.

31. A high capacity, low $NO_x$ radiant wall burner as set forth in claim 30, wherein said upstream extremity of said detached flame is positioned no more than about 3 inches from said nozzle.

32. A high capacity, low $NO_x$ radiant wall burner as set forth in claim 4, wherein said burner tube includes a curved portion which interconnects said downstream and upstream portions thereof, and wherein said secondary fuel system includes a segment of tubing which extends through a wall of said curved portion of the burner tube, said segment being connected in fluid communication with an upstream end of the fuel tube.

33. A high capacity, low $NO_x$ radiant wall burner as set forth in claim 32, wherein said segment of tubing and said fuel tube extend essentially along the axis of said downstream portion of the burner tube.

34. A high capacity, low $NO_x$ radiant wall burner as set forth in claim 3, wherein said secondary fuel system includes a segment of tubing that is connected in fluid communication with an upstream end of the fuel tube, said segment extending through said fitting and through said spud, said spud including a plurality of orifices for ejecting fluid fuel, said orifices being arranged around said segment of tubing.

35. A high capacity, low $NO_x$ radiant wall burner as set forth in claim 1 wherein said fuel comprises natural gas.

36. A high capacity, low $NO_x$ radiant wall burner as set forth in claim 1 wherein said fuel comprises hydrogen.

37. A radiant wall burner as set forth in claim 1, wherein said fuel-air mixture supply system is arranged and adapted for supplying in said mixture all of the air needed for combustion of said total fuel.

38. A radiant wall burner as set forth in claim 2, wherein said fuel-air mixture supply system is arranged and adapted for supplying in said mixture all of the air needed for combustion of said total fuel.

39. A high capacity, low $NO_x$ radiant wall burner as set forth in claim 3, wherein said secondary fuel system includes a segment of tubing which extends through a wall of said downstream portion of the burner tube, said segment being connected in fluid with an upstream end of the fuel tube.

40. A high capacity, low $NO_x$ radiant wall burner as set forth in claim 2, wherein said fitting is generally bell-shaped.

41. A burner assembly for a radiant burner comprising:

a burner tube structure comprising an elongated burner conduit having spaced inlet and outlet ends, said conduit being adapted and arranged for directing a fuel lean gaseous mixture comprising a portion of the total fluid fuel to be combusted and oxygen therealong from said inlet end to said outlet end;

a main burner nozzle at the outlet end of said conduit, said burner nozzle having a central axis, a wall extending around a centrally located cavity therein, and a downstream end spaced from said outlet end of the conduit, said main burner nozzle being arranged and adapted for receiving said mixture from the conduit in said cavity and redirecting the same through a plurality of apertures in said wall and into a combustion zone in a direction transverse to said axis, said apertures being distributed around said wall, whereby the mixture directed into the combustion zone through said apertures is generally in the form of a round flat pattern that surrounds said wall and extends outwardly across a radiant surface; and a secondary fuel tube delivery system including an elongated fuel tube extending along said axis and a secondary fuel nozzle located at a downstream end portion of the fuel tube, said secondary fuel nozzle including a secondary fuel port that is located and arranged so as to discharge a flow of secondary fuel and cause the same to travel in a direction outwardly away from said surface to a location that is axially spaced from and out of contact with said combustion zone, whereby the secondary fuel will have an opportunity become mixed with flue gases before undergoing combustion with excess air in the combustion zone.

42. A burner assembly as set forth in claim 41, further comprising a fuel-air mixture supply system providing a source of a fuel lean combustible fuel-air mixture for introduction into the inlet end of said burner conduit, said fuel-air mixture supply system being arranged and configured to establish a fuel lean fuel to air ratio in said fuel-air mixture whereby the latter has a predetermined low flame speed, said apertures being arranged and configured to dispense said combustible fuel-air mixture in said transverse direction at an initial velocity which exceeds the predetermined flame speed of the mixture and in said pattern, whereby a round flame that is detached from the nozzle is created upon combustion of the mixture.

43. A high capacity, low $NO_x$ radiant wall burner as set forth in claim 42, wherein said secondary fuel nozzle system is configured and arranged such that the secondary fuel is pure fuel.

44. A high capacity, low $NO_x$ radiant wall burner as set forth in claim 42, wherein said a fuel-air mixture supply system and said main nozzle are configured and arranged such that said fuel-air mixture includes all of the air required for combusting said fuel.

45. A high capacity, low $NO_x$ radiant wall burner as set forth in claim 43, wherein said a fuel-air mixture supply system and said main nozzle are configured and arranged such that said fuel-air mixture includes all of the air required for combusting said fuel.

46. A high capacity, low $NO_x$ radiant wall burner as set forth in claim 42, wherein said a fuel-air mixture supply system and said main nozzle are configured and arranged such that said fuel-air mixture includes no more than 55% of the total fuel combusted in said burner.

47. A high capacity, low $NO_x$ radiant wall burner as set forth in claim 43, wherein said a fuel-air mixture supply system and said main nozzle are configured and arranged such that said fuel-air mixture includes no more than 55% of the total fuel combusted in said burner.

48. A high capacity, low $NO_x$ radiant wall burner as set forth in claim 44, wherein said a fuel-air mixture supply system and said main nozzle are configured and arranged such that said fuel-air mixture includes no more than 55% of the total fuel combusted in said burner.

49. A high capacity, low $NO_x$ radiant wall burner as set forth in claim 45, wherein said a fuel-air mixture supply system and said main nozzle are configured and arranged such that said fuel-air mixture includes no more than 55% of the total fuel combusted in said burner.

50. A high capacity, low $NO_x$ radiant wall burner as set forth in claim 41, wherein the downstream end of the main burner nozzle has a hole in it and said elongated fuel tube extends axially through the cavity with the secondary fuel nozzle projecting through said hole.

51. A high capacity, low $NO_x$ radiant wall burner as set forth in claim 41, wherein said elongated fuel tube extends along an outer periphery of main burner nozzle.

52. A burner assembly as set forth in claim 41, wherein said mixture comprises a mixture of a gaseous fuel and air, and said burner tube structure comprises a venturi tube which uses a flow of said gaseous fuel to induce a flow of air, whereby to create said mixture.

53. A burner assembly as set forth in claim 41, wherein said mixture comprises a mixture of a gaseous fuel and air, and said burner tube structure comprises a plurality of venturi tubes arranged for parallel flow, each of said venturis being adapted and arranged to use a flow of said gaseous fuel to induce a flow of air, whereby to generate said mixture as an ultra fuel lean mixture of fuel and air.

54. A burner assembly as set forth in claim 41, wherein said elongated fuel tube is located externally of said main fuel nozzle and said secondary fuel port is located and arranged so as to deliver secondary fuel at a velocity and in a direction such that at least a portion of the secondary fuel pierces said pattern to reach said location.

55. A burner assembly as set forth in claim 41, wherein said fuel lean gaseous, mixture includes all of the oxygen needed for combustion of the total fuel.

56. A burner assembly as set forth in claim 53, wherein said fuel lean gaseous mixture includes all of the air needed for combustion of the total fuel.

57. A burner assembly as set forth in claim 41, wherein said radiant surface is part of a refractory burner tile inserted in a wall of a furnace, and wherein said main burner nozzle extends through a passageway in said tile.

58. A high capacity, low $NO_x$ radiant wall burner as set forth in claim 41, wherein said burner tube structure and said secondary fuel delivery system are arranged such that the amount of said secondary fuel delivered to said location constitutes at least about 30% of the total fuel provided to the combustion zone.

59. A high capacity, low $NO_x$ radiant wall burner as set forth in claim 58, wherein said burner tube structure and said secondary fuel delivery system are arranged such that the amount of said secondary fuel delivered to said location constitutes at least about 50% of the total fuel provided to the combustion zone.

60. A high capacity, low $NO_x$ radiant wall burner as set forth in claim 41, wherein said main burner nozzle is arranged and adapted for redirecting the gaseous mixture at an initial velocity which exceeds the flame speed of the mixture, whereby said round flame is detached from the nozzle.

61. A burner assembly as set forth in claim 42, wherein said fuel-air mixing system comprises at least one venturi tube, said venturi tube being adapted and arranged to use a flow of said gaseous fuel to induce a flow of air, whereby to gene mixture as an ultra fuel lean mixture of fuel and air.

62. A radiant wall burner as set forth in claim 42, wherein said fuel-air mixing system is arranged and adapted for supplying in said mixture all of the air needed for combustion of said total fuel.

63. A radiant wall burner as set forth in claim 61, wherein said fuel-air mixing system is arranged and adapted for supplying in said mixture all of the air needed for combustion of said total fuel.

64. A method for operating a high capacity, low $NO_x$ radiant wall burner to heat a radiant surface adjacent a combustion zone in a furnace chamber, said method comprising:

providing a fuel lean combustible fuel-air mixture;

providing an elongated main nozzle having a longitudinal axis;

causing the fuel-air mixture to flow radially outwardly from said main nozzle, into said combustion zone and generally across said radiant surface in a circular pattern which essentially surrounds said main nozzle in a radial direction;

combusting said mixture in said zone; and discharging a flow of secondary fuel into said furnace chamber and causing the same to travel in a direction outwardly away from said radiant surface to a location in said furnace chamber that is axially spaced from and out of contract with said zone, said location being sufficiently remote from said zone to permit the secondary fuel to become intermixed with flue gases before it has time to return to the zone for combustion with excess oxygen in the zone.

65. A method for operating a high capacity, low $NO_x$ radiant wall burner as set forth in claim 64, further comprising establishing a fuel lean fuel to air ratio in said fuel-air mixture at a level such that the flame speed of the mixture is less than the velocity of the same as its flows radially outwardly from said nozzle, whereby a flame that is detached from said nozzle results during combustion of the mixture.

66. A method for operating a high capacity, low $NO_x$ radiant wall burner as set forth in claim 64, wherein said secondary fuel constitutes more than 20% of the total fuel provided to the combustion zone.

67. A method for operating a high capacity, low $NO_x$ radiant wall burner as set forth in claim 66, wherein said secondary fuel constitutes at least about 30% of the total fuel provided to the combustion zone.

68. A method for operating a high capacity, low $NO_x$ radiant wall burner as set forth in claim 67, wherein said secondary fuel constitutes at least about 50% of the total fuel provided to the combustion zone.

69. A method for operating a high capacity, low $NO_x$ radiant wall burner as set forth in claim 64, wherein said secondary fuel is provided at said location using a secondary fuel nozzle which extends through said main nozzle.

70. A method for operating a high capacity, low $NO_x$ radiant wall burner as set forth in claim 66, wherein said secondary fuel is provided at said location using a secondary fuel nozzle which emits a jet of fuel that pierces said pattern without combusting.

71. A method as set forth in claim 66, wherein said fuel-air mixture supply system includes all of the air needed for combustion of said total fuel.

72. A high capacity, low $NO_x$ radiant wall burner as set forth in claim 64, wherein is included the step of causing the fuel-air mixture to flow outwardly from said main nozzle at an initial velocity which exceeds the flame speed of the mixture, whereby a detached round flame is created when the mixture is combusting.

73. A method for operating a radiant burner comprising:

delivering a flow of a fuel lean combustible mixture comprising a portion of the total fuel to be combusted and air in a radial direction from an elongated nozzle having a central axis to a combustion zone surrounding said nozzle in the form of a round, flat pattern, said zone being located in a furnace chamber adjacent a radiant surface;

establishing a fuel lean fuel to air ratio in said mixture at a level such that the flame speed of the mixture is less than the velocity thereof as the same is delivered to said combustion zone, whereby a flame that is detached from said nozzle results during combustion of the mixture;

igniting said mixture to create a round flat detached flame which surrounds said nozzle in a radial direction and is located adjacent said radiant surface; and discharging a flow of secondary fuel into said furnace chamber and causing the same to travel in a direction outwardly away from said radiant surface to a location in said furnace chamber that is axially spaced from and out of contact with said zone, said location being sufficiently remote from said zone to permit the secondary fuel to become intermixed with flue gases before it has time to return to the zone for combustion with excess oxygen in the zone.

74. A method as set forth in claim 73, wherein said fuel lean combustible mixture system includes all of the air needed for combustion of said total fuel.

75. A method as set forth in claim 73, wherein said radiant surface is part of a refractory burner tile inserted in a wall of a furnace, and wherein said elongated nozzle extends through a passageway in said tile.

76. A method for operating a high capacity, low $NO_x$ radiant wall burner as set forth in claim 73, wherein said secondary fuel constitutes at least about 30% of the total fuel provided to the combustion zone.

77. A method for operating a high capacity, low $NO_x$ radiant wall burner as set forth in claim 76, wherein said secondary fuel constitutes at least about 50% of the total fuel provided to the combustion zone.

78. A method as set forth in claim 73, wherein said mixture is an ultra fuel lean mixture of fuel and air.

79. A method as set forth in claim 78, wherein said mixture includes all of the air needed for combustion of said total fuel.

* * * * *